US008197027B2

(12) United States Patent
Yamaguchi

(10) Patent No.: US 8,197,027 B2
(45) Date of Patent: Jun. 12, 2012

(54) LIQUID EJECTION APPARATUS

(75) Inventor: Shunji Yamaguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 324 days.

(21) Appl. No.: 12/701,215

(22) Filed: Feb. 5, 2010

(65) Prior Publication Data

US 2010/0201739 A1 Aug. 12, 2010

(30) Foreign Application Priority Data

Feb. 12, 2009 (JP) ..... 2009-030536

(51) Int. Cl.
*B41J 2/165* (2006.01)
*B41J 2/155* (2006.01)

(52) U.S. Cl. ..... 347/33; 347/32; 347/42

(58) Field of Classification Search ..... 347/32, 347/33

See application file for complete search history.

(56) References Cited

U.S. PATENT DOCUMENTS

2005/0083369 A1* 4/2005 Silverbrook ..... 347/33
2006/0001696 A1* 1/2006 Ha et al. ..... 347/32
2007/0040864 A1* 2/2007 Jung et al. ..... 347/22

FOREIGN PATENT DOCUMENTS

JP 01063180 A * 3/1989
JP 2001-071521 3/2001
JP 2005-103770 4/2005
JP 2007-011377 1/2007
JP 2007-050704 3/2007

* cited by examiner

*Primary Examiner* — Shelby Fidler
(74) *Attorney, Agent, or Firm* — SNR Denton US LLP

(57) ABSTRACT

A liquid ejection apparatus includes a rotating moving table that is rotatable between a horizontal orientation and a vertical orientation and movable in a horizontal direction; a head cap that is movable so as to come into contact with or become spaced from the liquid ejection surface; and an interlocking mechanism that interlocks the rotating moving table with the head cap. The rotating moving table has a platen portion on which a target of ejection of a liquid can be carried; and a cleaning portion that can clean the liquid ejection surface. When the rotating moving table has been rotated to the horizontal orientation, the head cap is situated in a position spaced from the liquid ejection surface. When the rotating moving table has been rotated to the vertical orientation and is not being moved in the horizontal direction, the head cap can come into contact with the liquid ejection surface.

8 Claims, 14 Drawing Sheets

LIQUID EJECTION APPARATUS

BACKGROUND OF THE INVENTION

1. Field of the Invention

The present invention relates to a liquid ejection apparatus in which switching can easily be performed from a printing state to a cleaning state or a waiting state for a liquid ejection head having formed therein a nozzle row that ejects a liquid.

2. Description of the Related Art

In a liquid ejection apparatus such as an ink jet printer, a liquid is ejected from a nozzle row formed in a liquid ejection head, and an image or the like is formed on a recording sheet. Therefore, if an image or the like is formed while an ink ejection surface of the liquid ejection head from which the liquid is ejected (the portion in which the nozzle row is formed) is dirty, or while a liquid, dirt or the like adheres to the surface, the quality of printing is degraded. Especially, in the case of a full-color ink jet printer, if an ink (a liquid) of a color different from that of another ink flows back through a nozzle into where the latter ink is, the former is mixed with the latter ink and, upon printing, an ink of mixed colors is ejected, which degrades the quality of the image.

Thus, in order to prevent degradation of the quality of printing and maintain the performance of the liquid ejection head, there are various methods for performing head maintenance in accordance with purposes. For example, there is a technique in which a somewhat hard rubber blade is pressed against the ink ejection surface (the liquid ejection surface) of a liquid ejection head and slides on the ink ejection surface to clean the surface. In this rubber-blade method, dirt adhering to the ink ejection surface, an accumulated ink, an ink that has become viscous or solid or the like is wiped off and removed. By performing such wiping, the ink ejection surface is kept clean and a stable performance of ink ejection can be obtained.

There is another head-maintenance technique in which the ink ejection surface of a liquid ejection head is capped so that adhesion of dirt or drying is prevented. Specifically, when the apparatus is in a waiting state, such as when printing is not being performed, a head cap in the form of an upwardly open shallow box is brought into contact with the ink ejection surface to cover the ink ejection surface. As a result, since the interior of the head cap becomes sealed, the ink ejection surface is protected from dust and foreign matter and is not easily dried, so that clogging of the nozzles can be prevented.

There is still another technique in which ink is sucked from the ink-ejection-surface side using a pump while the ink ejection surface is in a capped airtight state, so that dirt and bubbles in the liquid ejection head are forced out together with the liquid. By performing negative-pressure suction in this way, dirt and bubbles, which are a cause of unsuccessful ejection, are removed from inside the liquid ejection head so that a stable performance of ink ejection can be obtained. There is still another technique in which a liquid-absorbing member made of a porous material or the like is provided at the inner bottom portion of a head cap and impregnated with a moisturizing liquid (water, ink or the like), which evaporates and thereby the ink ejection surface is wetted and prevented from drying in an active manner.

Thus, there are head-maintenance techniques in which the ink ejection surface is wiped, capped and so on. However, in order to perform wiping or capping, a mechanism that moves the rubber blade translationally between the ink ejection surface of the liquid ejection head and a printing table, a mechanism that moves the head cap up and down, or the like is necessary. Also, considerations of physical relationships are necessary in order that these head-maintenance operations do not interfere with one another. Therefore, these techniques can lead to increased complexity of the mechanism and increase in the cost or the size of the ink jet printer.

For this reason, there is a technique in which a platen portion, a cap portion, an ink-absorbing portion and a wiper portion are separately arranged on the outer periphery of a rotatable platen unit. In this technique, the platen unit is driven to rotate and slide so as to perform a recording-sheet-supporting operation in a printing state, a wiping operation in a cleaning state and a capping operation in a waiting state. Thus, the space occupied by the head-maintenance mechanism is reduced to make the ink jet printer small.

There is also another technique in which a rotating member is arranged below the liquid ejection head. The rotating member has a head-maintenance portion including a rubber blade, a head cap and the like, and a platen portion in the form of ribs that supports the back side of a recording sheet. In this technique, by rotating the rotating member, switching can be performed between four states of capping (in a waiting state), wiping (in a cleaning state), priming (in a cleaning state) and printing. Therefore, the time necessary for head maintenance can be reduced and, moreover, the head-maintenance mechanism can be simplified.

SUMMARY OF THE INVENTION

However, in either of these techniques, since a cap portion is provided on the outer peripheral surface of a rotating member, when capping is not being performed, the cap portion, which possibly contains waste ink, is reversed or tilted. As a result, upon switching to a non-capping state, the waste ink drops down and fouls the surroundings. Moreover, the moisturizing liquid, which is provided to prevent drying, also tends to flow out. Even if a liquid-absorbing member is provided and impregnated with the moisturizing liquid, it is difficult to hold the moisturizing liquid in the cap portion.

Moreover, in these techniques, a suction tube, which is provided to remove bubbles in the liquid ejection head and discharge waste ink accumulated in the cap portion, has a complicated piping structure. Specifically, in order to remove bubbles and the like, a suction pump is connected to the cap portion and sucks and discharges ink. For this purpose, a suction tube is connected between the cap portion and the suction pump, thereby forming a flow path for waste ink.

However, in the case where the cap portion is part of the rotating member, if the cap portion and the suction pump are simply connected, the suction tube will be twisted. To cope with this problem, in the technique of Japanese Unexamined Patent Application Publication No. 2003-11377, a hollow supporting shaft is provided. However, the hollow supporting shaft has to be configured such that the connection between a movable part and a fixed part is rotatable and liquid-tight. Therefore, great care has to be taken to ensure liquid-tightness during the assembly and management of the components.

Meanwhile, if a platen portion having on its outer peripheral surface a rubber blade is rotated to perform wiping as in Japanese Unexamined Patent Application Publication No. 2001-71521, since the trajectory of the rubber blade forms an arc of a circle, the contact pressure against the ink ejection surface varies. As a result, as compared to the case where wiping is performed while maintaining the optimum contact pressure by using horizontal movement, areas on the ink ejection surface often fail to be wiped and, moreover, the area that can be wiped is small.

Therefore, it is desirable to provide a liquid ejection apparatus in which switching can be performed between the printing state, the cleaning state, and the waiting state with a simple configuration, in which fouling due to the outflow of waste ink does not occur, and in which the ink ejection surface can be wiped thoroughly.

According to an embodiment of the present invention, there is provided a liquid ejection apparatus including a plurality of nozzles that eject a liquid; a liquid ejection head in which a nozzle row of the nozzles arrayed in one direction is formed; a rotating moving table that is rotatable between a horizontal orientation and a vertical orientation relative to a portion of the liquid ejection head in which the nozzle row is formed, and movable in a horizontal direction relative to the portion of the liquid ejection head in which the nozzle row is formed; a head cap that is movable so as to come into contact with or become spaced from the portion of the liquid ejection head in which the nozzle row is formed; and interlocking means that interlocks the rotation and movement of the rotating moving table with the movement of the head cap. The rotating moving table has a platen portion on which a target of ejection of a liquid can be carried when the rotating moving table has been rotated to the horizontal orientation by the interlocking means; and a cleaning portion that can clean the portion in which the nozzle row is formed when the rotating moving table has been rotated to the vertical orientation and is being moved in the horizontal direction by the interlocking means. When the rotating moving table has been rotated to the horizontal orientation, the head cap is situated in a position spaced from the portion in which the nozzle row is formed by using the interlocking means. When the rotating moving table has been rotated to the vertical orientation and is not being moved in the horizontal direction, the head cap can come into contact with the portion in which the nozzle row is formed by using the interlocking means.

The above-described embodiment of the present invention includes the rotating moving table that is rotatable between the horizontal orientation and the vertical orientation relative to the portion of the liquid ejection head in which the nozzle row is formed, and movable in the horizontal direction relative to the portion of the liquid ejection head in which the nozzle row is formed; the head cap that is movable so as to come into contact with or become spaced from the portion in which the nozzle row is formed; and the interlocking means that interlocks the rotation and movement of the rotating moving table with the movement of the head cap. Therefore, physical interference between the rotating moving table and the head cap is avoided by using the interlocking means.

The rotating moving table includes the platen portion on which the target of ejection of liquid can be carried when the rotating moving table has been rotated to the horizontal orientation; and the cleaning portion that can clean the portion in which the nozzle row is formed when the rotating moving table has been rotated to the vertical orientation and is being moved in the horizontal direction. Therefore, switching can be performed between the printing state and the cleaning state by using the rotation and movement of the rotating moving table. Furthermore, since the cleaning is performed by horizontally moving the rotating moving table, the portion in which the nozzle row is formed is uniformly cleaned.

When the rotating moving table has been rotated to the horizontal orientation, the head cap is situated in a position spaced from the portion in which the nozzle row is formed. When the rotating moving table has been rotated to the vertical orientation and is not being moved in the horizontal direction, the head cap can come into contact with the portion in which the nozzle row is formed. Therefore, the head cap can be switched to the waiting state (capping) without interfering with the rotating moving table. Furthermore, since the capping is performed by moving the head cap, problems arising in the case where the head cap is rotated, such as the outflow of waste ink in the head cap and the twisting of the suction tube, can be avoided.

According to an embodiment of the present invention, switching can easily be performed between the printing state, the cleaning state and the waiting state for the liquid ejection head without interference between the rotating moving table and the head cap. Moreover, the portion in which the nozzle row is formed can be cleaned uniformly, and fouling due to the outflow of waste ink or the like can be prevented.

DESCRIPTION OF THE PREFERRED EMBODIMENT

Figure 1:
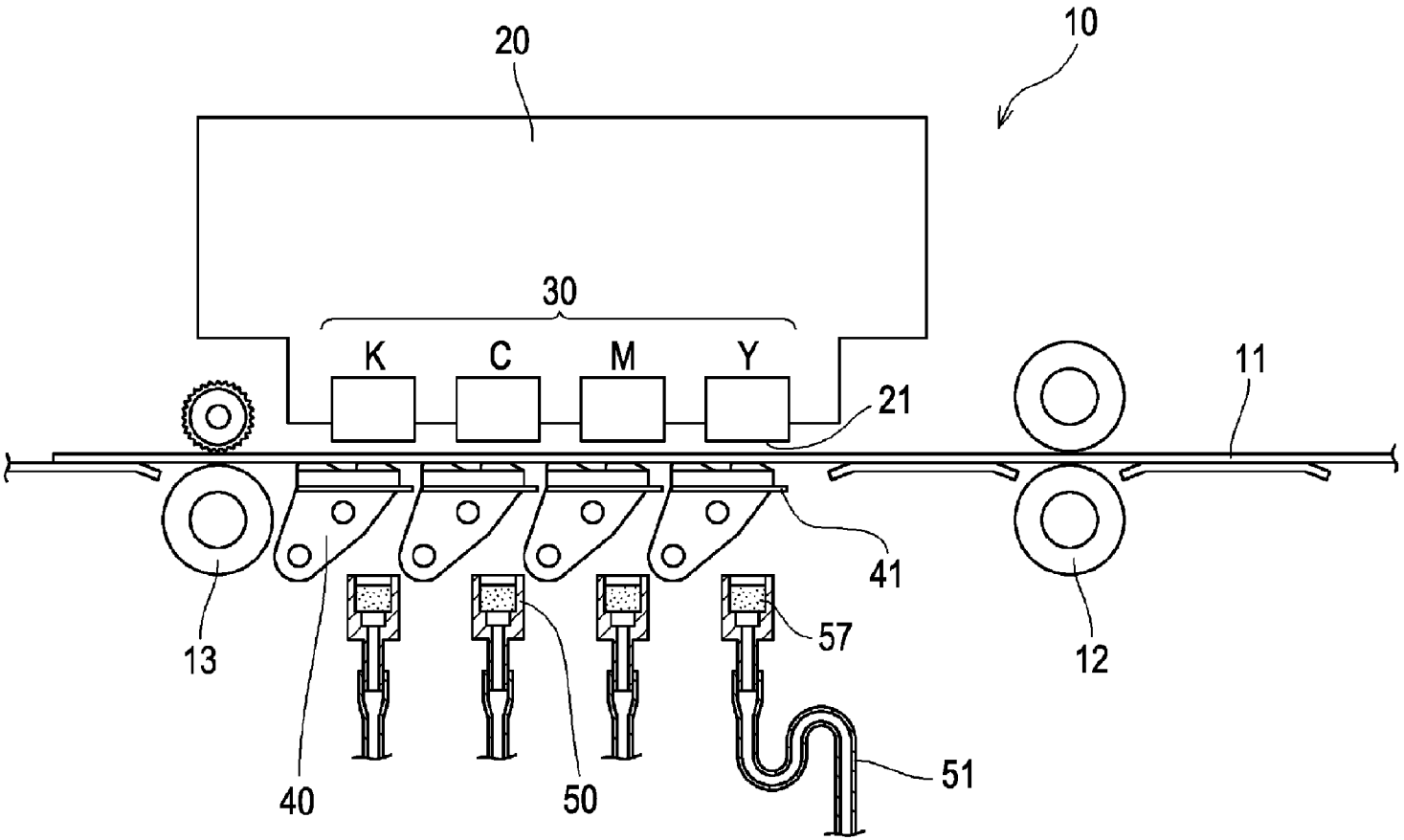
FIG. 1 is a schematic side view of an ink jet printer as a liquid ejection apparatus according to an embodiment of the present invention.

An embodiment of the present invention is described below with reference to the drawings.

A liquid ejection apparatus of the following embodiment of the present invention is an ink jet printer 10 that ejects ink as a liquid. The ink jet printer 10 is a line-type ink jet printer, and has a line head 20 (liquid ejection head of an embodiment of the present invention) of a length corresponding to the width of printing (for example, A4 size). The line head 20 has formed therein nozzle rows 32*a*, each of which has a plurality of nozzles 32 that eject ink. The nozzles 32 are arranged in one direction at a predetermined pitch over a length corresponding to the width of a recording sheet 11 (target of ejection of an embodiment of the present invention) having the largest printable size. The nozzle rows 32*a* are formed in an ink ejection surface 21. The ink jet printer 10 is adapted for color printing, and the nozzle rows 32*a* are formed for each of the ink colors: yellow (Y), magenta (M), cyan (C) and black (K).

Example of Configuration of Liquid Ejection Apparatus

FIG. 1 is a schematic side view of the ink jet printer 10 as the liquid ejection apparatus according to an embodiment of the present invention.

As shown in FIG. 1, the ink jet printer 10 performs printing on a recording sheet 11 conveyed from a sheet feeding section (not shown). Therefore, the ink jet printer 10 has a sheet feeding roller 12 that feeds the recording sheet 11 and a sheet discharge roller 13 that discharges the printed recording sheet 11 to a paper tray (not shown).

The ink jet printer 10 has the line head 20 that ejects ink to the recording sheet 11 and forms an image. The line head 20 has four head modules 30 that separately eject inks of the respective colors: yellow (Y), magenta (M), cyan (C) and black (K).

The ink jet printer 10 has four printing tables 40 (rotating moving table of an embodiment of the present invention) arrayed such that the printing tables 40 correspond to the head modules 30. These four printing tables 40 are rotatable between a horizontal orientation and a vertical orientation relative to the ink ejection surface 21 of the line head 20. The recording sheet 11 can be carried on the printing tables 40 when they have rotated to the horizontal orientation (the state shown in FIG. 1). Each of the printing tables 40 has a rubber blade 41 (cleaning portion of an embodiment of the present invention) so that, when the printing tables 40 have rotated to the vertical orientation, the ink ejection surface 21 can be cleaned.

The ink jet printer 10 has four head caps 50 that protect the ink ejection surface 21 of the line head 20 at the portions of the corresponding head modules 30. Each of the head caps 50 has a suction tube 51 connected thereto. Bubbles in the head modules 30 are removed or waste inks accumulated in the head caps 50 are discharged outside through the suction tubes 51 by suction by a suction pump (not shown).

An absorbent member 57 made of a porous material is provided at the inner bottom portion of each of the head caps 50. The absorbent members 57 are impregnated with a moisturizing liquid (water, ink or the like). Therefore, when the head caps 50 abut the ink ejection surface 21, the ink ejection surface 21 covered by the head caps 50 becomes wet owing to evaporation of the moisturizing liquid. Thus, the drying of the ink ejection surface 21 can be prevented in an active manner.

The head caps 50 are movable up and down so as to come into contact with or become spaced from the ink ejection surface 21. As shown in FIG. 1, when the printing tables 40 have rotated to the horizontal orientation, the head caps 50 are farther from the ink ejection surface 21 than the printing tables 40. The suction tubes 51 are connected to the suction pump (not shown) with slack in each of them. Therefore, even when the head caps 50 move up and down, undue stress on the joints, twisting, bending and the like can be avoided. Moreover, the waste ink and moisturizing liquid retained in the head caps 50 can be prevented from flowing outside.

Example of Configuration of Liquid Ejection Head

Figure 2:
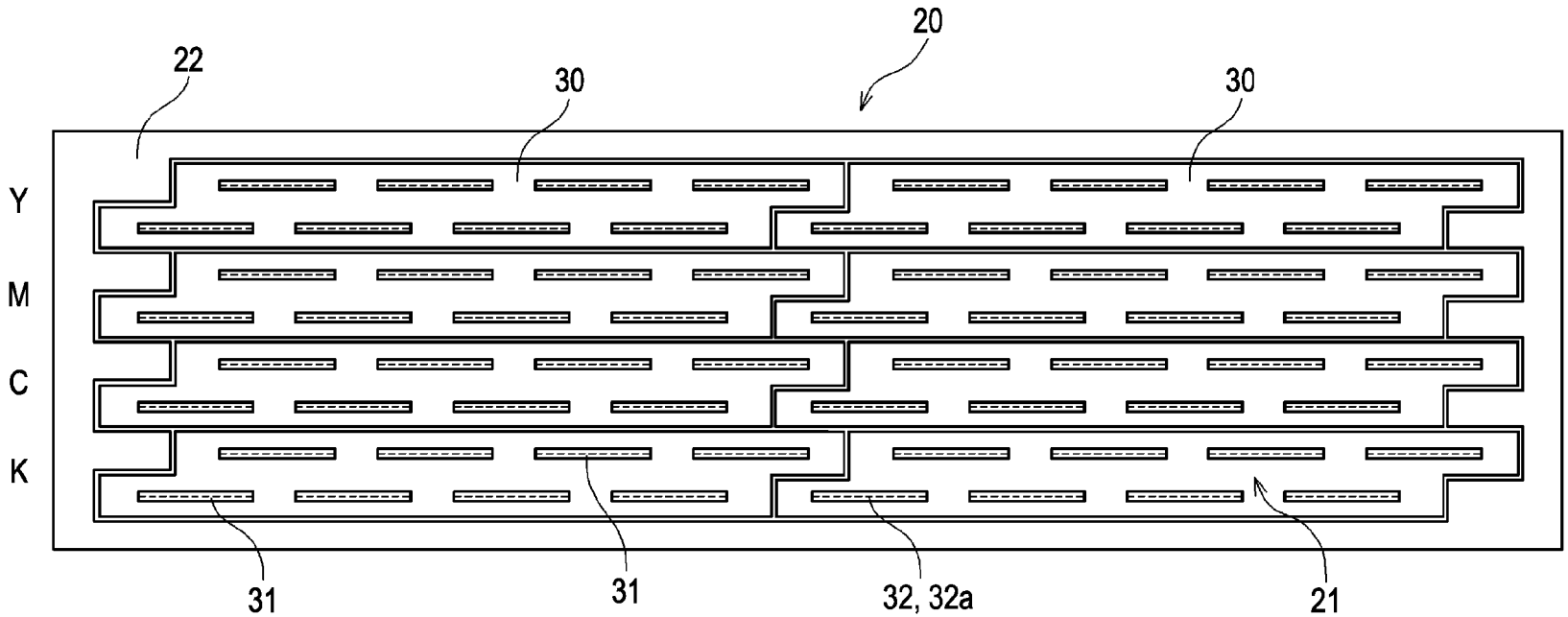
FIG. 2 is a plan view of a line head of the ink jet printer shown in FIG. 1 viewed from the ink-ejection-surface side.

FIG. 2 is a plan view of the line head 20 of the ink jet printer 10 shown in FIG. 1, viewed from the ink ejection surface 21 side.

As shown in FIG. 2, the line head 20 has a head frame 22 and a plurality of head modules 30 held by the head frame 22. Specifically, the head modules 30 are inserted in the head frame 22 with every two head modules 30 connected serially in the longitudinal direction of the head frame 22 (the width direction of a sheet). Each of the pairs of head modules 30 has a length corresponding to the width of the recording sheet 11 (see FIG. 1) having the largest printable size (the lateral width of A4, for example), and performs printing of one color. A pair of serially connected head modules 30 constitutes one line, and four lines (eight head modules 30 in total) are provided parallel to one another. The lines eject inks of the respective colors: yellow (Y), magenta (M), cyan (C) and black (K), thereby forming a full-color image.

Each of the head modules 30 has a plurality of head chips 31. Specifically, each head module 30 has two rows of four head chips 31 (eight head chips 31 in total) arranged in a staggered pattern. Each head chip 31 has a plurality of nozzles 32 that eject ink, arrayed in one direction and constituting a nozzle row 32*a*. Therefore, each head module 30 has two parallel nozzle rows 32*a*, and the entire line head 20 has eight parallel rows. At the same time, the array of the nozzles 32 extends over the length corresponding to the width of the recording sheet 11 (see FIG. 1). The ink ejection surface 21 is the portion in which the nozzle rows 32*a* are formed (the surface on the side where the nozzle rows 32*a* are formed). The distances between adjacent nozzles 32 are all equal, including adjacent portions in the staggered pattern.

As ink is repeatedly ejected from the nozzles 32, sometimes the ink accumulates on the ink ejection surface 21, or dust or foreign matter adheres to the ink ejection surface 21. If such a condition continues, the ejection of ink from the nozzles 32 is inhibited, resulting in unsuccessful ejection where some nozzles fail to eject or incompletely eject ink, for example.

Moreover, in the line head 20, which is adapted for full-color printing, inks of different colors accumulate and adhere to the ink ejection surface 21. Therefore, sometimes an accumulated ink of a color different from that of the ink residing in a head module 30 flows back into the head module 30 through the nozzles 32. This is mixed with the residing ink and as a result an ink of mixed colors is ejected, causing degradation of the image quality, such as changes in density, deviation of hues, and streaks.

For this reason, the printing tables 40 (see FIG. 1) are rotated to an orientation perpendicular to the ink ejection surface 21, and moved in a direction perpendicular to the direction in which the nozzles are arrayed while the rubber blades 41 (see FIG. 1) provided on the printing tables 40 are in contact with the ink ejection surface 21, so that accumulated inks and the like are wiped off. The width of the rubber blades 41 is slightly larger than the distance between both ends of the eight rows parallelly arranged in the shorter-side direction of the line head 20. Therefore, the rubber blades 41 can cover the entire width of the ink ejection surface 21.

Example of Configuration of Rotating Moving Table

Figure 3A:
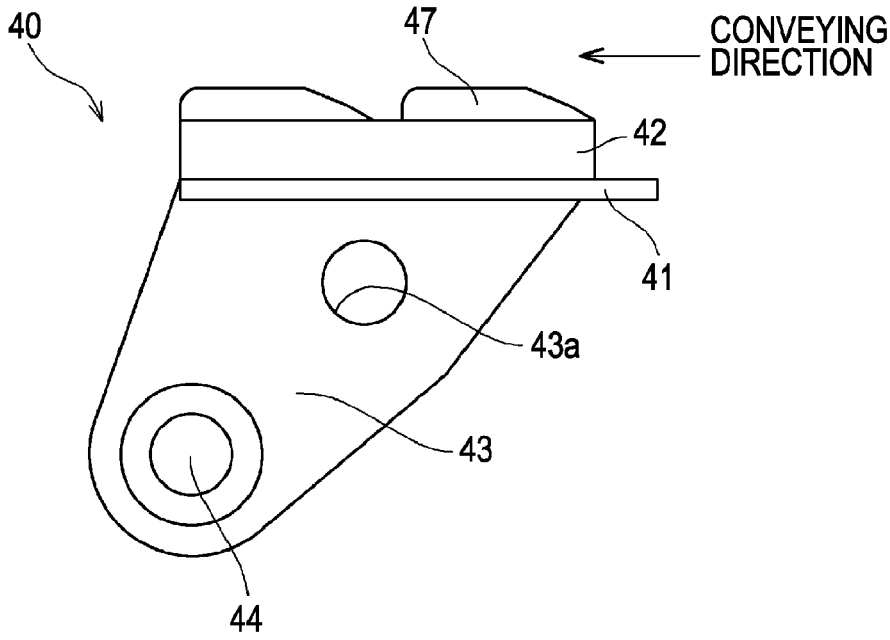
FIGS. 3A and 3B are side views of one of printing tables of the ink jet printer shown in FIG. 1.
Figure 3B:
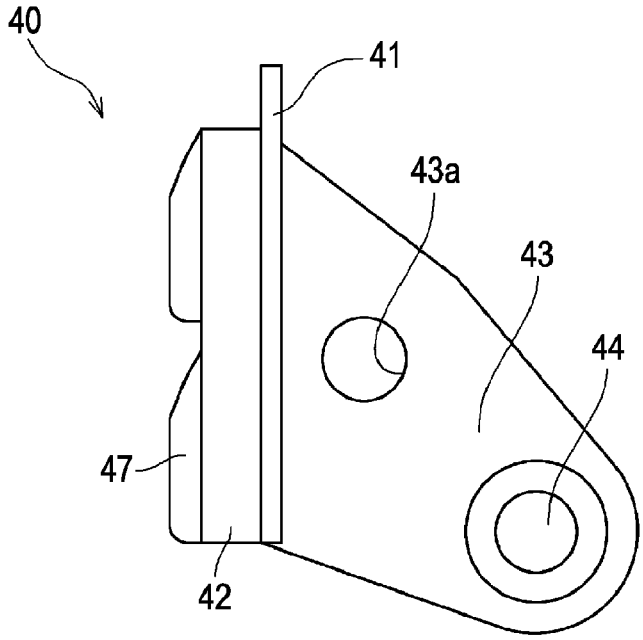

FIGS. 3A and 3B are side views of one of the printing tables 40 of the ink jet printer 10 shown in FIG. 1.

Figure 4:
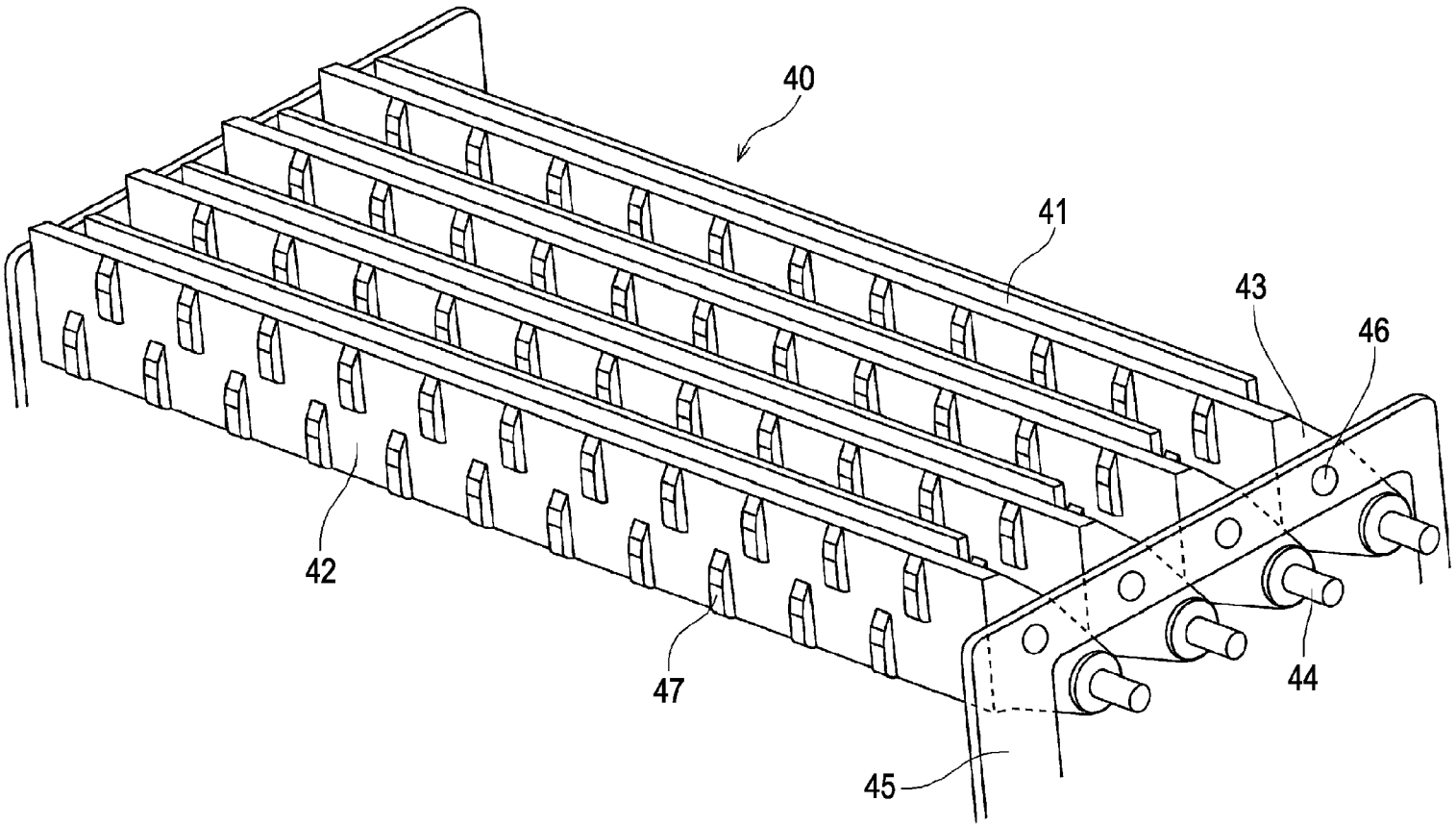
FIG. 4 is a perspective view of the printing tables of the ink jet printer shown in FIG. 1.

FIG. 4 is a perspective view of the printing tables 40 of the ink jet printer 10 shown in FIG. 1.

As shown in FIGS. 3A and 3B, the printing table 40 is an article molded from resin, and has a rubber blade 41, a platen portion 42, and a rotation-supporting portion 43, all of which are formed integrally. The rubber blade 41 (made of ethylene-propylene-diene rubber in the present embodiment) is molded integrally with the platen portion 42, which is made of resin, by using a method such as double molding. The platen portion 42 is molded integrally with the rotation-supporting portion 43 at each end in the width direction. In the rotation-supporting portion 43, a fulcrum hole 43*a* is formed and an open/close pin 44 made of metal is provided in a position eccentric to the fulcrum hole 43*a*.

Four printing tables 40, corresponding to the four lines of head modules 30 (see FIG. 2), are arranged and attached to a supporting frame 45, as shown in FIG. 4. Specifically, the printing tables 40 are rotatably pivoted on the single supporting frame 45 by inserting a fulcrum shaft 46 in each of the fulcrum holes 43*a* (see FIGS. 3A and 3B). The open/close pins 44 are exposed through an opening in the supporting frame 45.

Therefore, when the open/close pins 44 of the printing tables 40 are simultaneously reciprocated in a horizontal direction to serve as effort points, the printing tables 40 are simultaneously rotated (rocked) about the fulcrum shafts 46. Thus, the printing tables 40 are rotated to the horizontal orientation (the state shown in FIG. 3A) or the vertical orientation (the state shown in FIGS. 3B and 4). Moreover, when the supporting frame 45 is moved in a horizontal direction, the printing tables 40 are simultaneously moved in the horizontal direction.

When the printing tables 40 have been rotated to the horizontal orientation (the state shown in FIG. 3A), the recording sheet 11 can be carried on the platen portions 42, as shown in FIG. 1. The recording sheet 11 is supported on its back side (the surface that is not printed) parallel to the ink ejection surface 21. As shown in FIG. 3A, a plurality of ribs 47 protruding from the platen portions 42 are provided such that the ribs 47 extend in the direction in which the recording sheet 11 is conveyed from the sheet feeding side to the sheet discharge side. Therefore, the recording sheet 11 contacts the platen portions 42 partly (only contacts the upper surfaces of the ribs 47) on its back side, and is conveyed smoothly.

Meanwhile, when the printing tables 40 have been rotated to the vertical orientation, the rubber blades 41 are upright as shown in FIGS. 3B and 4. At this time, the edges of the rubber blades 41 are in contact with the ink ejection surface 21 (see FIG. 2), and they correspond to the lines of head modules 30 (see FIG. 2). Therefore, when the supporting frame 45 is moved in the horizontal direction with the printing tables 40 having been rotated to the vertical orientation, the rubber blades 41, which correspond to the head modules 30, slide on the ink ejection surface 21. Therefore, as the printing tables 40 move in a horizontal direction, the rubber blades 41 wipe off accumulated inks, dust, foreign matter and the like adhering to the ink ejection surface 21.

Example of Configuration of Head Cap

Figure 5:
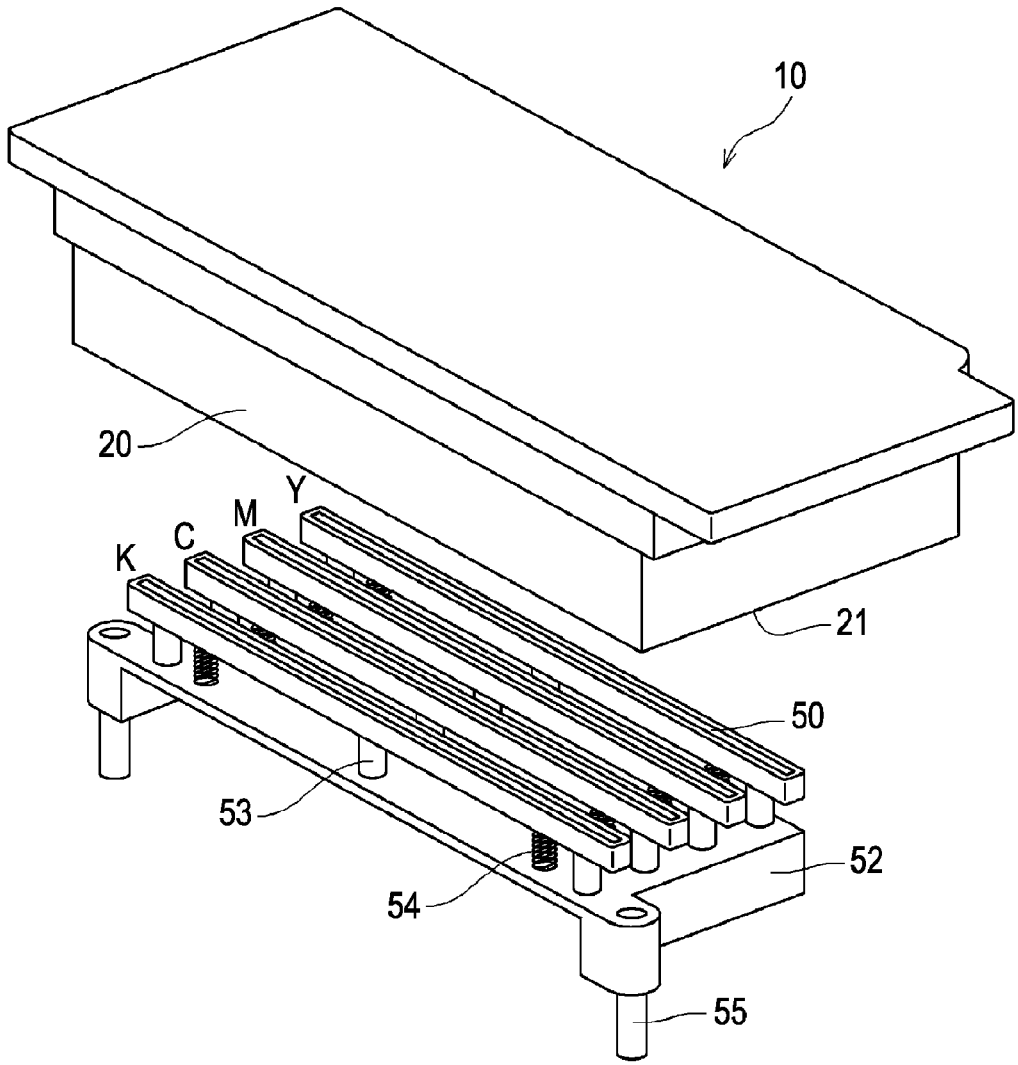
FIG. 5 is a perspective view of head caps of the ink jet printer shown in FIG. 1.

FIG. 5 is a perspective view of the head caps 50 of the ink jet printer 10 shown in FIG. 1.

As shown in FIG. 5, the head caps 50 are in the form of elongated, upwardly open shallow boxes extending over a length approximately equal to that of the ink ejection surface 21 of the line head 20. The head caps 50 prevent drying or clogging of the nozzles 32 (see FIG. 2) by abutting the ink ejection surface 21 on their upper sides and covering the peripheries of the nozzle rows 32*a* (see FIG. 2).

Four head caps 50, corresponding to the four lines of head modules 30 (see FIG. 2), are arranged and mounted on a cap base 52, as shown in FIG. 5. Specifically, three supporting shafts 53 are provided on each of the head caps 50 and inserted in the cap base 52 so that the head caps 50 are movable up and down. Two push-up springs 54 are interposed between the lower surface of each of the head caps 50 and the upper surface of the cap base 52, and the head caps 50 are urged upwardly.

The cap base 52 is movable in the vertical direction relative to the ink ejection surface 21 of the line head 20 owing to a vertical guide 55. Therefore, by lifting the cap base 52 along the vertical guide 55, each of the four head caps 50 comes into contact with the ink ejection surface 21. Then each of the head caps 50 presses the ink ejection surface 21 uniformly owing to the action of its push-up springs 54. Therefore, the nozzle rows 32*a* (see FIG. 2) become sealed in the corresponding head caps 50. As a result, the ink ejection surface 21 is protected from dust and foreign matter and moreover is prevented from drying so that clogging of the nozzles 32 (see FIG. 2) is prevented. In contrast, when the cap base 52 is lowered, the head caps 50 become spaced from the ink ejection surface 21.

Thus, the ink jet printer 10 of the present embodiment has four printing tables 40 and four head caps 50, and each of the four printing tables 40 has the rubber blade 41 and the platen portion 42. The printing tables 40 are rotatable between the horizontal orientation and the vertical orientation relative to the ink ejection surface 21 of the line head 20, and are movable in a horizontal direction. Meanwhile, the head caps 50 are movable so as to come into contact with or become spaced from the ink ejection surface 21 (in the vertical direction relative to the ink ejection surface 21 in the present embodiment). The rotation and movement of the printing tables 40 and the movement of the head caps 50 are interlocked by interlocking means, and the interlocking means switches between a waiting state, a cleaning state, and a printing state.

Figure 6:
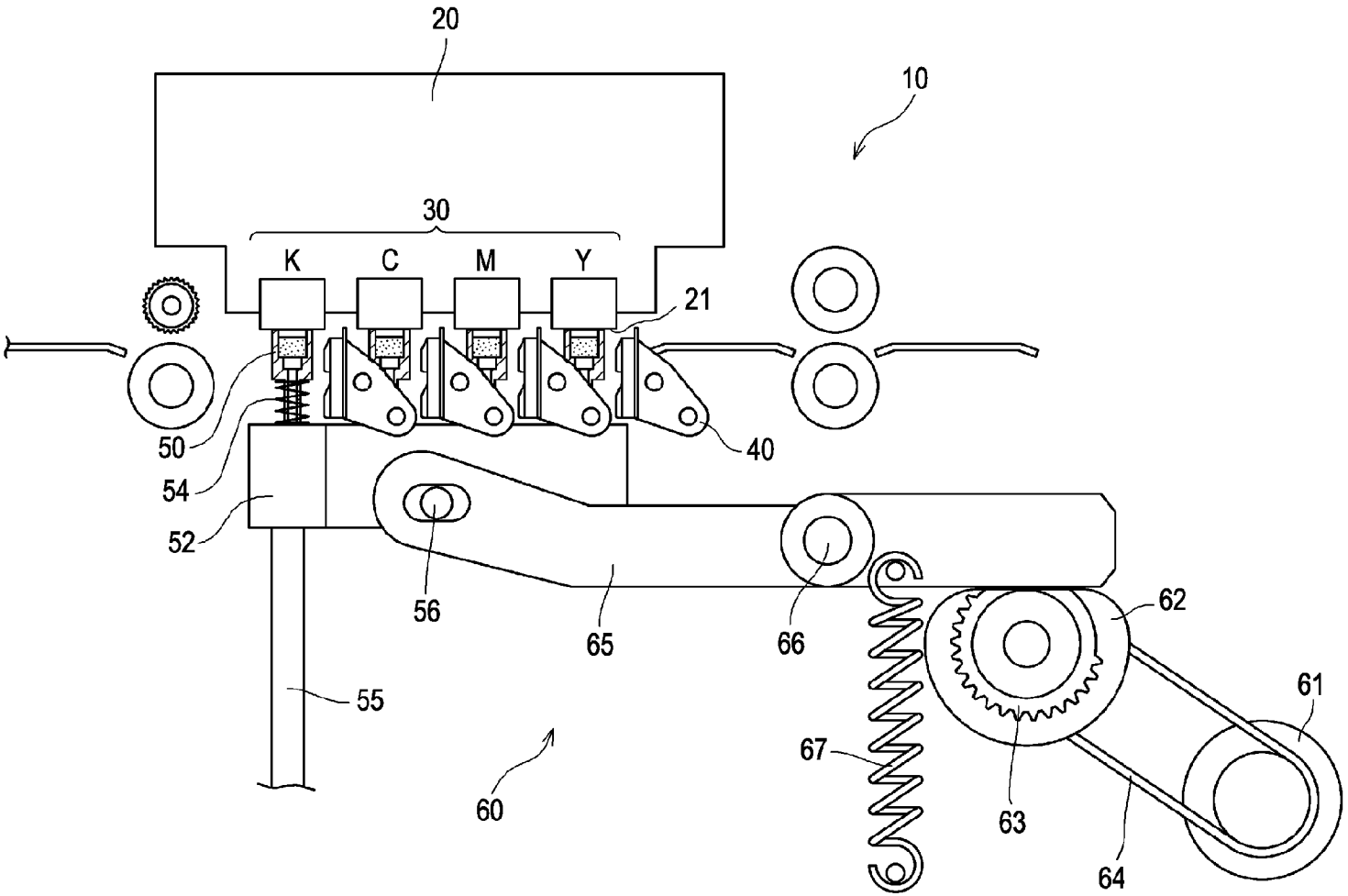
FIG. 6 is a side view of the head caps when the ink jet printer shown in FIG. 1 is in a waiting state.

FIG. 6 is a side view of the head caps 50 when the ink jet printer 10 shown in FIG. 1 is in the waiting state.

As shown in FIG. 6, when the ink jet printer 10 is in the waiting state, the head caps 50 abut the ink ejection surface 21 of the line head 20. The four head caps 50 corresponding to the four lines of head modules 30 for Y (yellow), M (magenta), C (cyan) and K (black) are arranged and mounted on the cap base 52.

By using an interlocking mechanism 60 (interlocking means of an embodiment of the present invention), the cap base 52 is movable in the vertical direction relative to the ink ejection surface 21 of the line head 20. Specifically, the interlocking mechanism 60 has a motor 61 (driving source of an embodiment of the present invention), a cam 62, a pinion gear 63, a transmission belt 64, a lifting lever 65, and a vertical tension spring 67. The lifting lever 65 is rotated (rocked) about a lifting fulcrum 66 by the cam 62, and moves the cap base 52 up and down through a lifting load point 56.

The waiting state of the ink jet printer 10 is shown in FIG. 6. In this state, the lifting lever 65 is carried on a horizontal portion of the cam 62. The lifting lever 65 is urged downward by the vertical tension spring 67 at a portion between the lifting fulcrum 66 and the cam 62. Therefore, an upward force acts on the lifting load point 56 and thereby the cap base 52 is pushed up along the vertical guide 55. As a result, the head caps 50 on the cap base 52 abut the ink ejection surface 21 and protect the ink ejection surface 21. Each of the head caps 50 presses the ink ejection surface 21 uniformly owing to the action of its push-up springs 54.

Thus, the head caps 50 are moved vertically by the action of the lifting lever 65, which is driven by the motor 61, and come into contact with the ink ejection surface 21. At this time, the printing tables 40 have been rotated to the vertical orientation (the state shown in FIG. 6) so that the printing tables 40 are not a hindrance. At this time, the printing tables 40 do not move in the horizontal direction.

Figure 7:
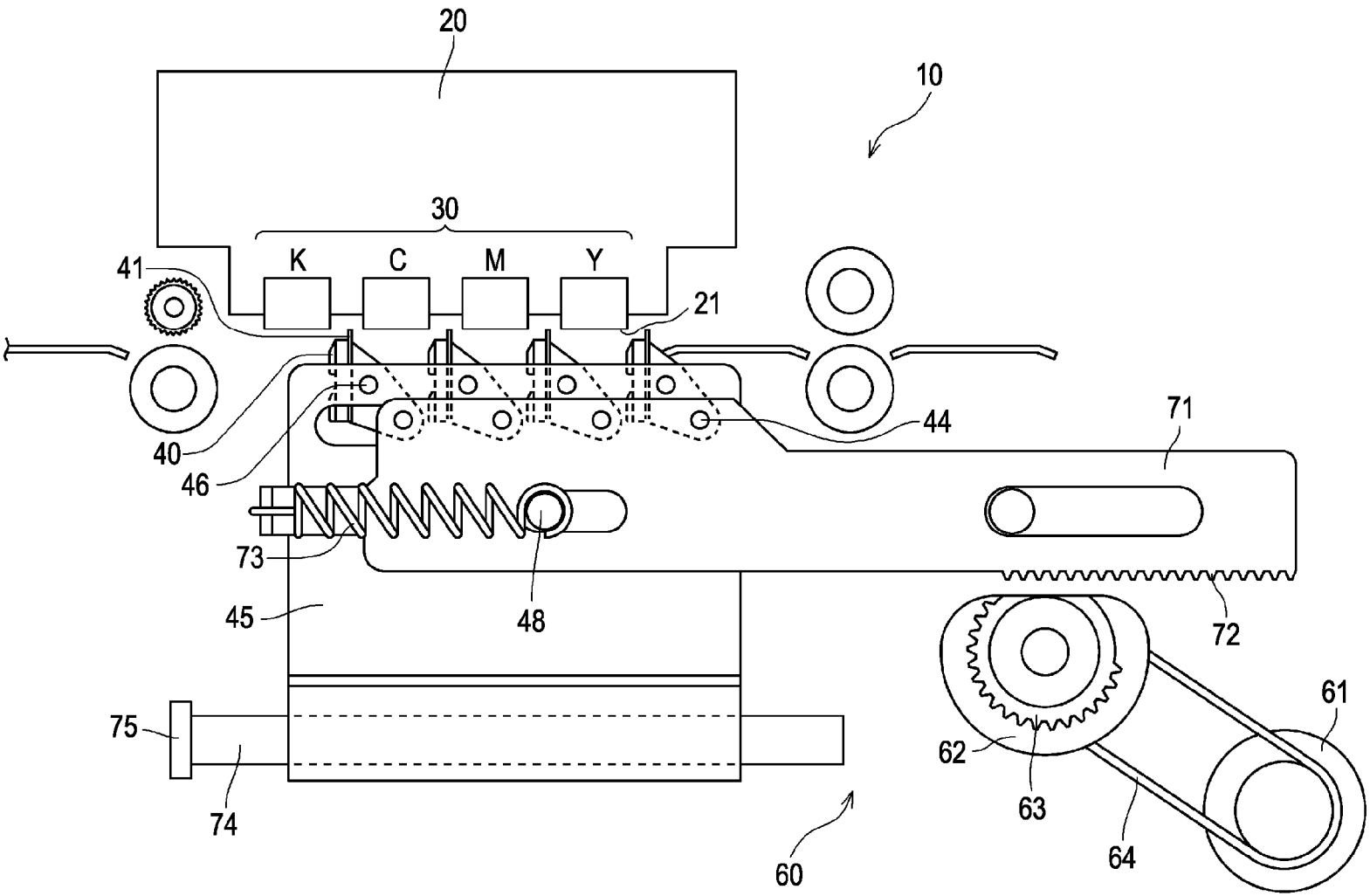
FIG. 7 is a side view of the printing tables when the ink jet printer shown in FIG. 1 is in the waiting state.

FIG. 7 is a side view of the printing tables 40 when the ink jet printer 10 shown in FIG. 1 is in the waiting state.

As shown in FIG. 7, the four printing tables 40 corresponding to the four lines of head modules 30 are rotatably mounted on the supporting frame 45 through the corresponding fulcrum shafts 46. Moreover, the printing tables 40 are rotatably mounted on a slide lever 71 through the open/close pins 44.

The slide lever 71 is an element of the interlocking mechanism 60, and moves in the horizontal direction owing to the engagement between a rack gear 72 and a pinion gear 63. A horizontal tension spring 73 (an element of the interlocking mechanism 60) is arranged between a frame-moving protrusion 48 of the supporting frame 45 and the slide lever 71. The supporting frame 45 can be moved in the horizontal direction along a horizontal guide 74 (an element of the interlocking mechanism 60) owing to the horizontal tension spring 73.

When in the waiting state shown in FIG. 7, the slide lever 71 is in a right-hand position relative to the supporting frame 45. As a result, because of the positional relationship between the fulcrum shafts 46 and the open/close pins 44, the printing tables 40 have been rotated to the vertical orientation relative to the ink ejection surface 21 of the line head 20. In addition, as shown in FIG. 6, the supporting frame 45 is positioned such that each of the head caps 50 is situated between two adjacent printing tables 40. Furthermore, as shown in FIG. 7, since the rack gear 72 is not engaged with the pinion gear 63, the slide lever 71 does not move.

Therefore, the printing tables 40 are not a hindrance when the head caps 50 come into contact with the ink ejection surface 21, as shown in FIG. 6. Specifically, each of the head caps 50 passes between two adjacent printing tables 40 and comes into contact with the ink ejection surface 21. This enables the ink jet printer 10 to be small.

Figure 8:
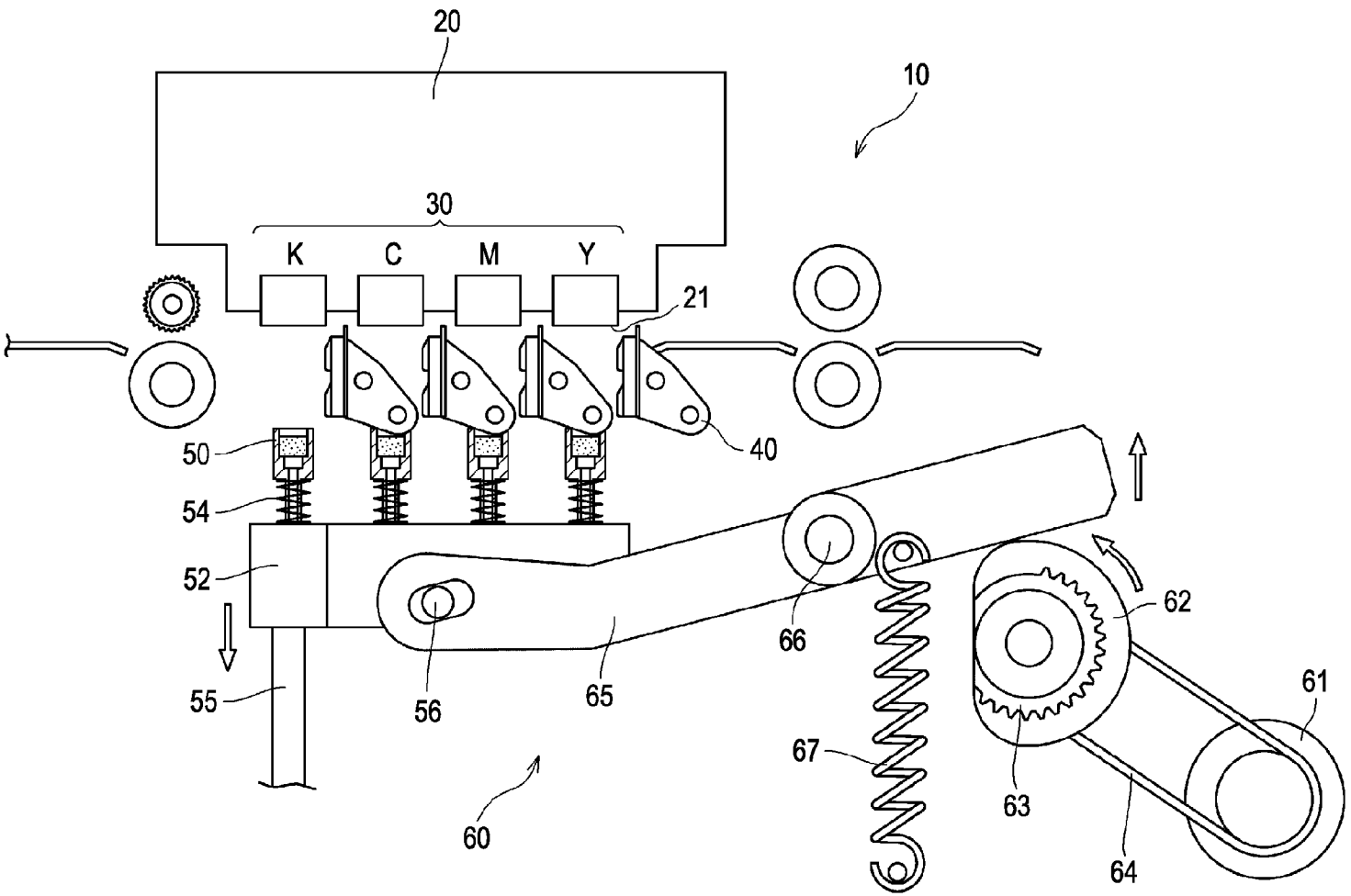
FIG. 8 is a side view of the head caps before the ink jet printer shown in FIG. 1 starts cleaning.

FIG. 8 is a side view of the head caps 50 before cleaning of the ink jet printer 10 shown in FIG. 1 is started.

To start the cleaning of the ink jet printer 10, first, the head caps 50 abutting the ink ejection surface 21 of the line head 20 are made to be spaced from the ink ejection surface 21. For this purpose, the motor 61 is rotationally driven in a CCW direction (a counterclockwise direction).

The driving force of the motor 61 is transmitted through the transmission belt 64 to the cam 62 and the pinion gear 63. Therefore, when the motor 61 is rotationally driven in the CCW direction, the cam 62 is also rotated in the CCW direction as shown by an arrow in FIG. 8. As a result, the portion of the lifting lever 65 on the same side of the lifting fulcrum 66 as the cam 62 is lifted against the urging by the vertical tension spring 67 and, in turn, the lifting-load-point-56 side is lowered. Thus, the cap base 52 is lowered and the head caps 50 become spaced from the ink ejection surface 21. At this time, since the head caps 50 are lowered in a direction parallel to the printing tables 40, the printing tables 40 are not a hindrance. Moreover, the printing tables 40 do not move in the horizontal direction.

Figure 9:
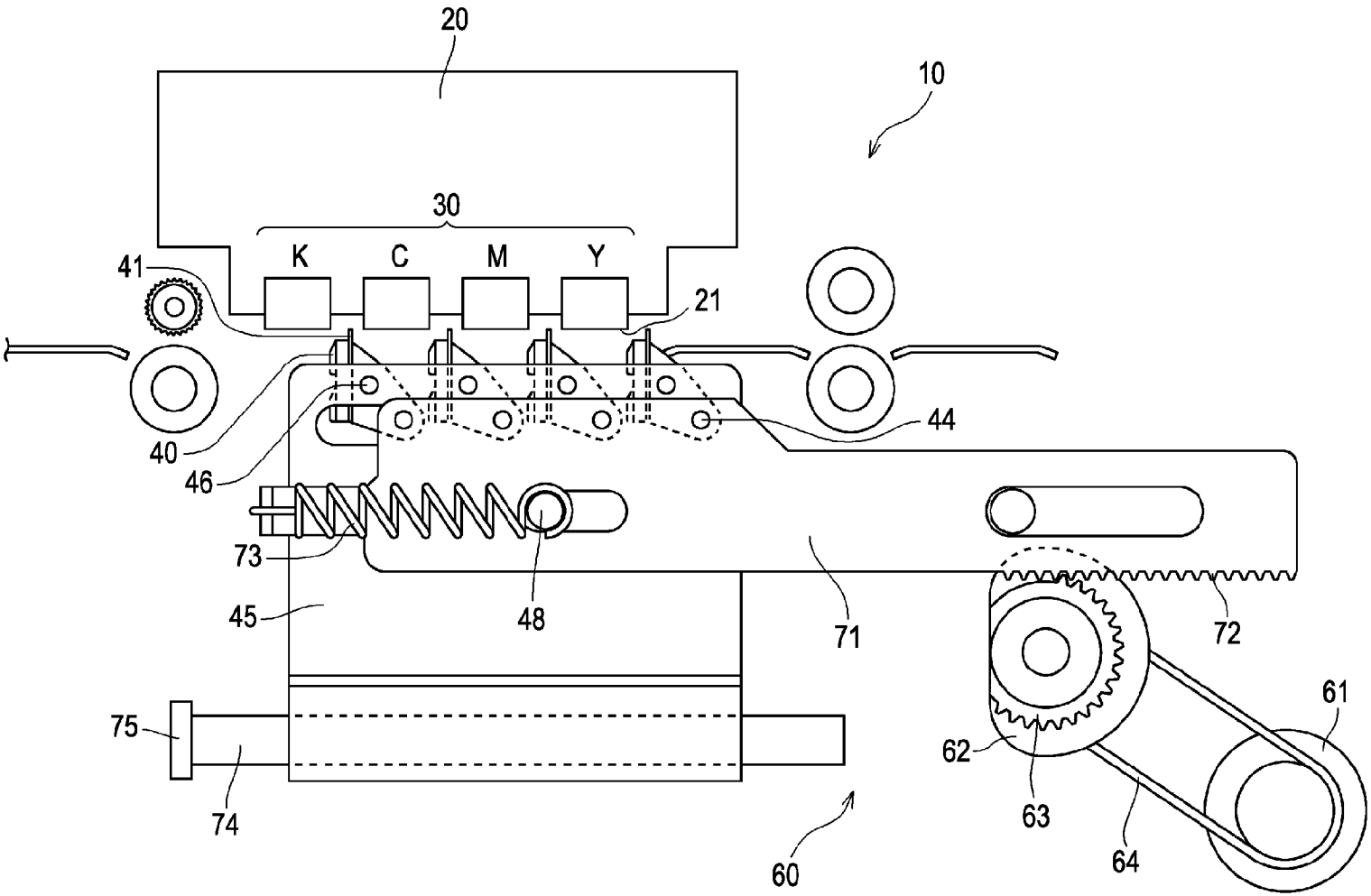
FIG. 9 is a side view of the printing tables before the ink jet printer shown in FIG. 1 starts cleaning.

FIG. 9 is a side view of the printing tables 40 before cleaning of the ink jet printer 10 shown in FIG. 1 is started.

When the motor 61 is rotationally driven in the CCW direction so that the head caps 50 (see FIG. 8) become spaced from the ink ejection surface 21, not only the cam 62 but also the pinion gear 63 is rotated in the CCW direction. Therefore, the pinion gear 63 is rotated to such a position that the cam 62 causes the head caps 50 to become spaced from the ink ejection surface 21 (the position shown in FIG. 8).

However, this position is a state immediately before the pinion gear 63 is engaged with the rack gear 72 and moves the rack gear 72. Therefore, the slide lever 71 does not move from the waiting state shown in FIG. 7. Specifically, the slide lever 71 is in a right-hand position relative to the supporting frame 45, and the printing tables 40 are maintained in a state where they have been rotated to the orientation perpendicular to the ink ejection surface 21. Therefore, as shown in FIG. 8, the printing tables 40 are not a hindrance when the head caps 50 become spaced from the ink ejection surface 21. Each of the head caps 50 is moved down between two adjacent printing tables 40 and becomes spaced from the ink ejection surface 21.

Figure 10:
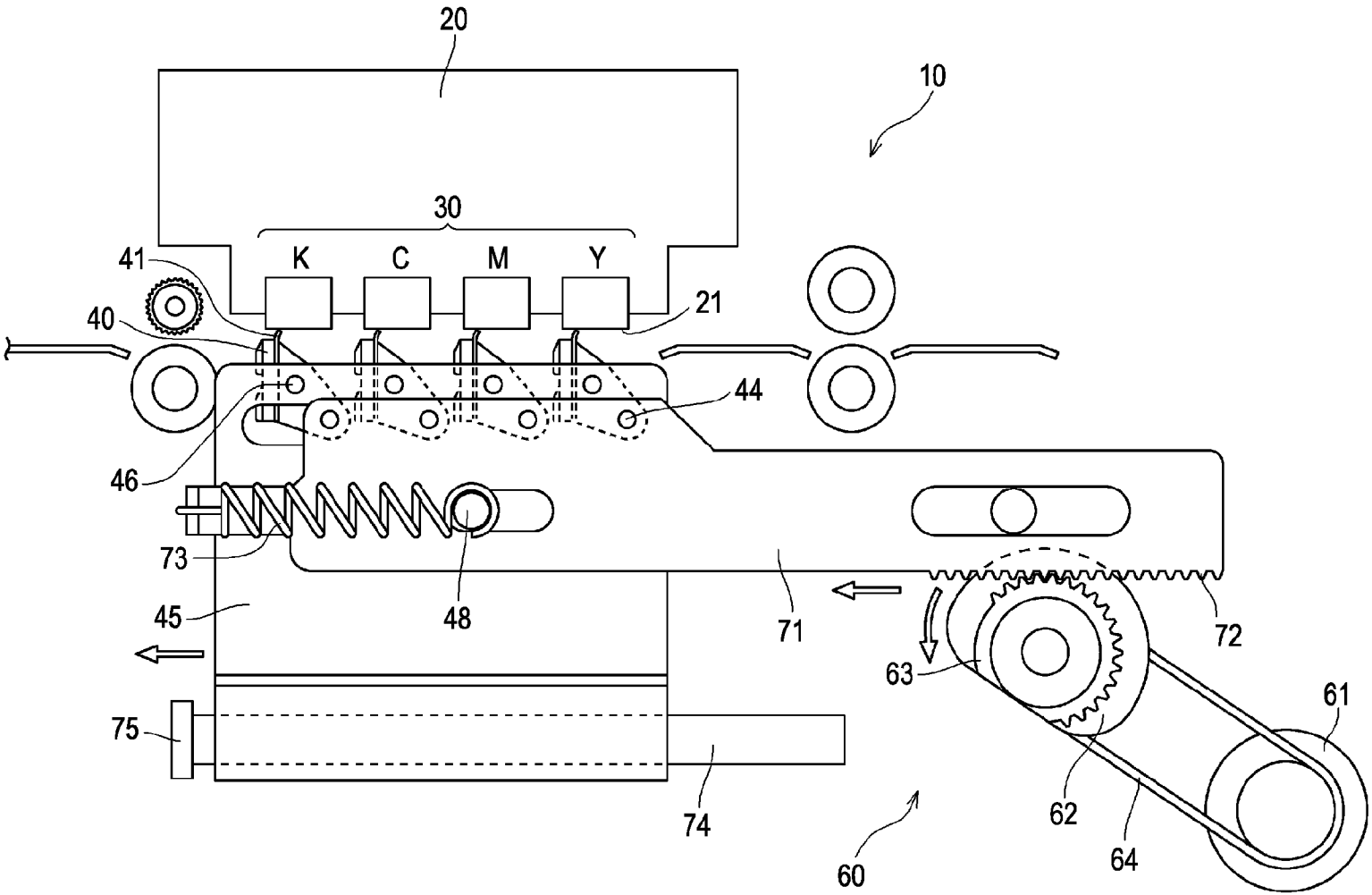
FIG. 10 is a side view of the printing tables when the ink jet printer shown in FIG. 1 is performing cleaning.

FIG. 10 is a side view of the printing tables 40 when the cleaning of the ink jet printer 10 shown in FIG. 1 is being performed.

When the motor 61 is rotationally driven further in the CCW direction from the state shown in FIG. 9, which is a state before the cleaning is started, the pinion gear 63 becomes engaged with the rack gear 72. As a result, the slide lever 71 is moved leftward as shown by an arrow in FIG. 10 owing to the rotation of the pinion gear 63 in the CCW direction.

When the slide lever 71 is moved leftward, the horizontal tension spring 73, that is attached to the tip portion of the slide lever 71 at one end thereof, is pulled leftward. Then the supporting frame 45 is also pulled leftward because the other end of the horizontal tension spring 73 is connected to the frame-moving protrusion 48 provided on the supporting frame 45. As a result, the supporting frame 45 moves in the horizontal direction along the horizontal guide 74 as shown by an arrow. Therefore, the slide lever 71 and the supporting frame 45 are moved leftward at the same time at the same speed.

The four printing tables 40 are mounted on the supporting frame 45 through the fulcrum shafts 46. Moreover, the printing tables 40 are mounted on the slide lever 71 through the open/close pins 44. Furthermore, the orientation of the printing tables 40 is determined by the positional relationship between the fulcrum shafts 46 and the open/close pins 44.

However, since the slide lever 71 and the supporting frame 45 are moved in the same manner, the positional relationship between the fulcrum shafts 46 and the open/close pins 44 does not change. Therefore, the printing tables 40 are moved horizontally leftward while keeping their orientation vertical relative to the ink ejection surface 21. As a result, the four rubber blades 41 provided on the corresponding printing tables 40 slide on the ink ejection surface 21, and accumulated inks and the like adhering to the ink ejection surface 21 are wiped off.

As described above, the printing tables 40 are moved horizontally leftward by the action of the slide lever 71 that is driven by the motor 61, and the rubber blades 41 perform cleaning by moving parallel to the ink ejection surface 21. Thus, the ink ejection surface 21 can be wiped thoroughly in an efficient manner. At this time, the head caps 50 (see FIG. 8) are maintained in a position farther from the ink ejection surface 21 than the printing tables 40 so that the head caps 50 are not a hindrance.

Figure 11:
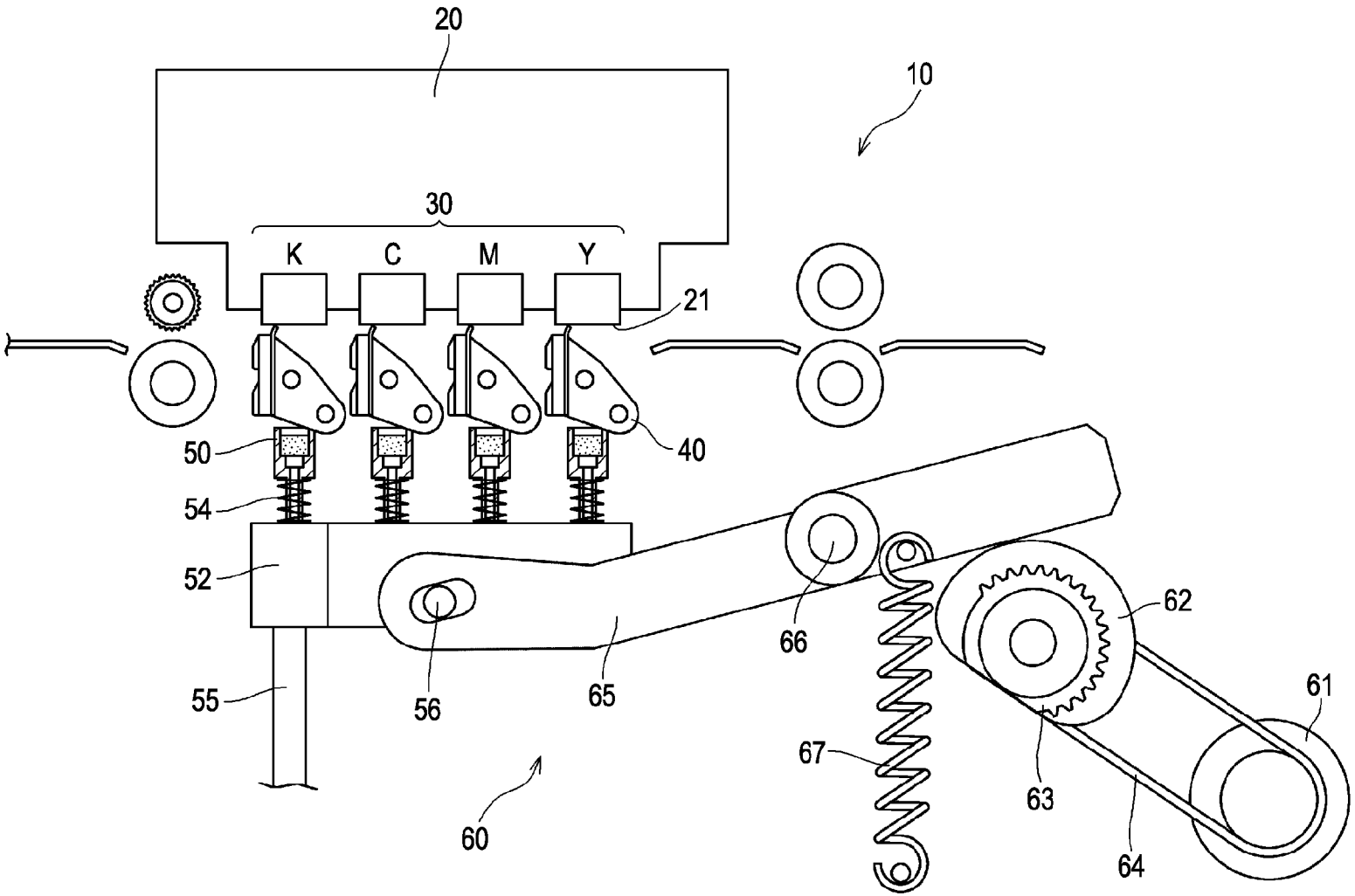
FIG. 11 is a side view of the head caps when the ink jet printer shown in FIG. 1 is performing cleaning.

FIG. 11 is a side view of the head caps 50 when the cleaning of the ink jet printer 10 shown in FIG. 1 is being performed.

When the motor 61 is rotationally driven in the CCW direction to move the printing tables 40 leftward and perform cleaning with the rubber blades 41, not only the pinion gear 63 but also the cam 62 is rotated in the CCW direction. Therefore, the rotational position of the cam 62 is such that the pinion gear 63 causes the rubber blades 41 to slide on the ink ejection surface 21 (the position shown in FIG. 10).

However, when in this position, the cam 62 carries the lifting lever 65 on a portion in the form of an arc having a constant radius, as shown in FIG. 11. Therefore, when the cam 62 rotates in the CCW direction, the lifting lever 65 remains in the state shown in FIG. 8, where the head caps 50 are maintained in the lowered state. Therefore, the head caps 50 are not a hindrance when the printing tables 40 are moved in the horizontal direction, and the printing tables 40 pass above the head caps 50.

Figure 12:
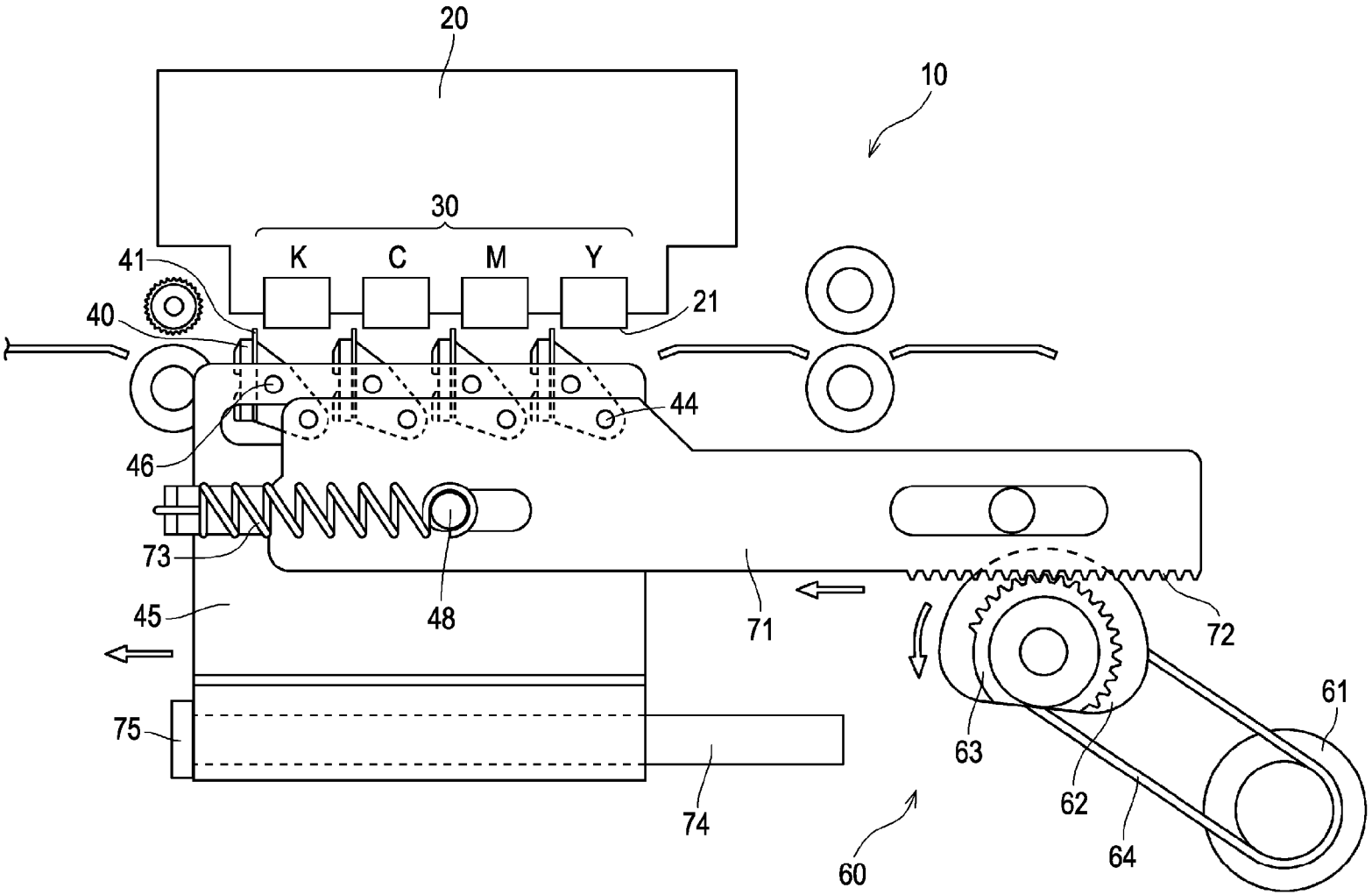
FIG. 12 is a side view of the printing tables after the ink jet printer shown in FIG. 1 has finished cleaning.

FIG. 12 is a side view of the printing tables 40 after the cleaning of the ink jet printer 10 shown in FIG. 1 is finished.

When the motor 61 is rotationally driven further in the CCW direction from a state in the course of cleaning (the state shown in FIG. 11), the slide lever 71, the horizontal tension spring 73, the supporting frame 45, and the printing tables 40 are moved further leftward as shown by an arrow in FIG. 12. Then the four rubber blades 41 of the corresponding printing tables 40 slide on the ink ejection surface 21 and pass through the corresponding four lines of head modules 30 of Y (yellow), M (magenta), C (cyan) and K (black).

When the rubber blades 41 have passed through the corresponding head modules 30, the left end of the supporting frame 45 abuts a stopper 75 of the horizontal guide 74. Thus, the leftward movement of the supporting frame 45 is stopped and the horizontal movement of the printing tables 40 ceases, whereupon one cycle of cleaning of the ink ejection surface 21 is finished. When in the position shown in FIG. 12 (the position where the cleaning is finished), the cam 62 still carries the lifting lever 65 (see FIG. 11) on the portion in the form of an arc having a constant radius. Therefore, the head caps 50 (see FIG. 11) are maintained in the position farther from the ink ejection surface 21 than the printing tables 40 and are not a hindrance when the cleaning is finished.

Figure 13:
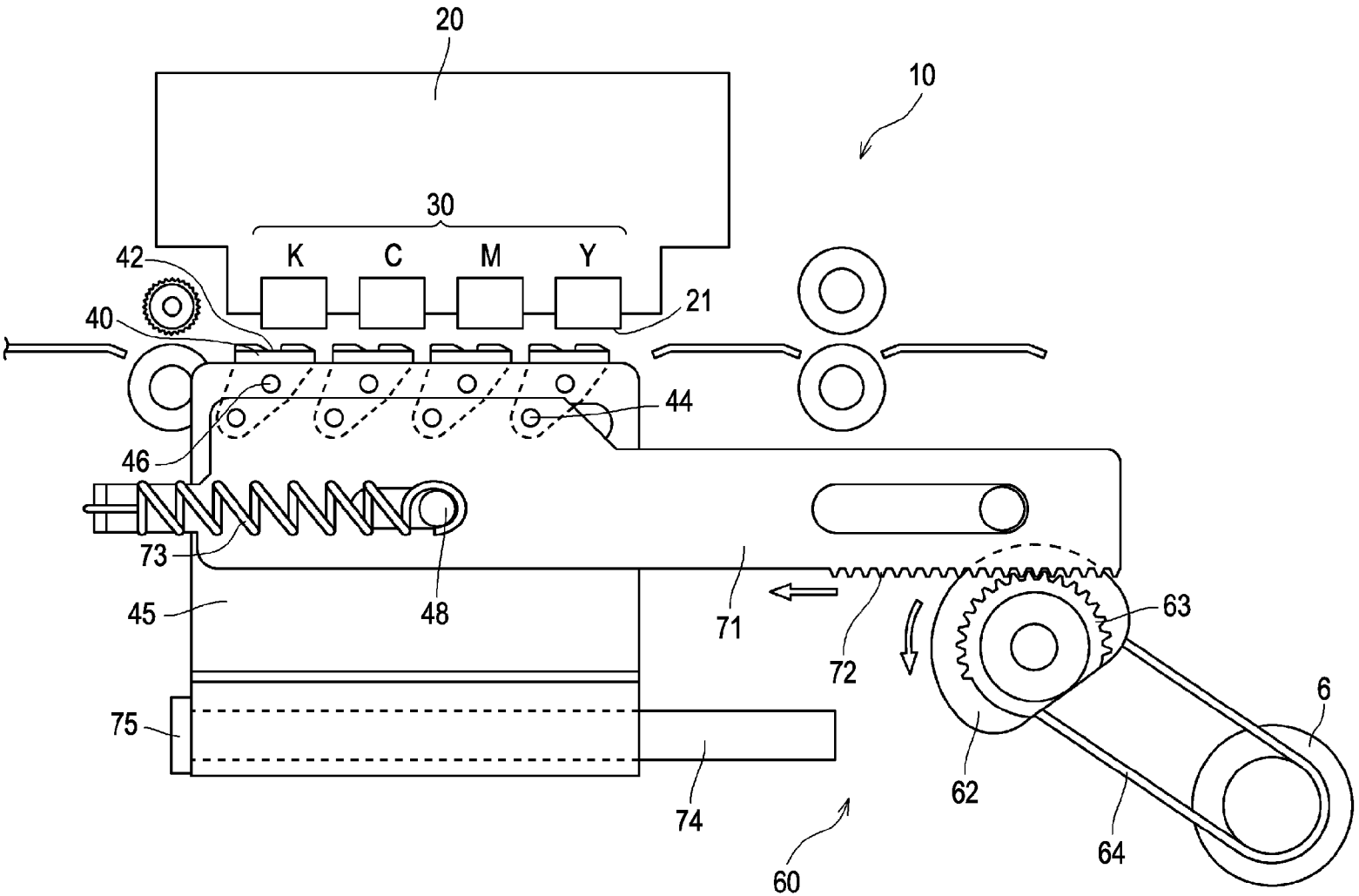
FIG. 13 is a side view of the printing tables when the ink jet printer shown in FIG. 1 is performing printing.

FIG. 13 is a side view of the printing tables 40 when the ink jet printer 10 shown in FIG. 1 is performing printing.

When the motor 61 is rotationally driven further in the CCW direction from the state shown in FIG. 12 (the state where the cleaning has been finished), the slide lever 71 is moved further leftward as shown by an arrow in FIG. 13. Meanwhile, the supporting frame 45 is prevented from moving leftward because it abuts the stopper 75 of the horizontal guide 74.

The horizontal tension spring 73 is connected between the frame-moving protrusion 48 of the supporting frame 45 and the slide lever 71. Therefore, even when the supporting frame 45 does not move, the slide lever 71 can be moved owing to stretching of the horizontal tension spring 73. As a result, the slide lever 71 is moved leftward while the supporting frame 45 is at rest, and the positional relationship between the supporting frame 45 and the slide lever 71 is changed.

The printing tables 40 are rotatably mounted on the supporting frame 45 through the fulcrum shafts 46. Moreover, the printing tables 40 are rotatably mounted on the slide lever 71 through the open/close pins 44. Therefore, when the slide lever 71 alone is moved leftward, the open/close pins 44 come to positions to the left of the corresponding fulcrum shafts 46. As a result, the printing tables 40 are rotated about the corresponding fulcrum shafts 46 and eventually become horizontal relative to the ink ejection surface 21 of the line head 20, as shown in FIG. 13.

When the printing tables 40 have rotated to the horizontal orientation as described above, the upper surfaces of the printing tables 40 serve as the platen portions 42 that can carry the recording sheet 11 (see FIG. 1). Then the recording sheet 11 can be supported by the platen portions 42 on its back side (the surface that is not printed) such that the recording sheet 11 is parallel to the ink ejection surface 21. Thus, the recording sheet 11 is conveyed from a sheet feeding section (not shown) to the platen portions 42 and inks of the colors are ejected from the head modules 30 to perform printing. Even when in the state of performing printing as shown in FIG. 13, the head caps 50 (see FIG. 11) are maintained in the position farther from the ink ejection surface 21 than the printing tables 40 so that the head caps 50 are not a hindrance.

Figure 14:
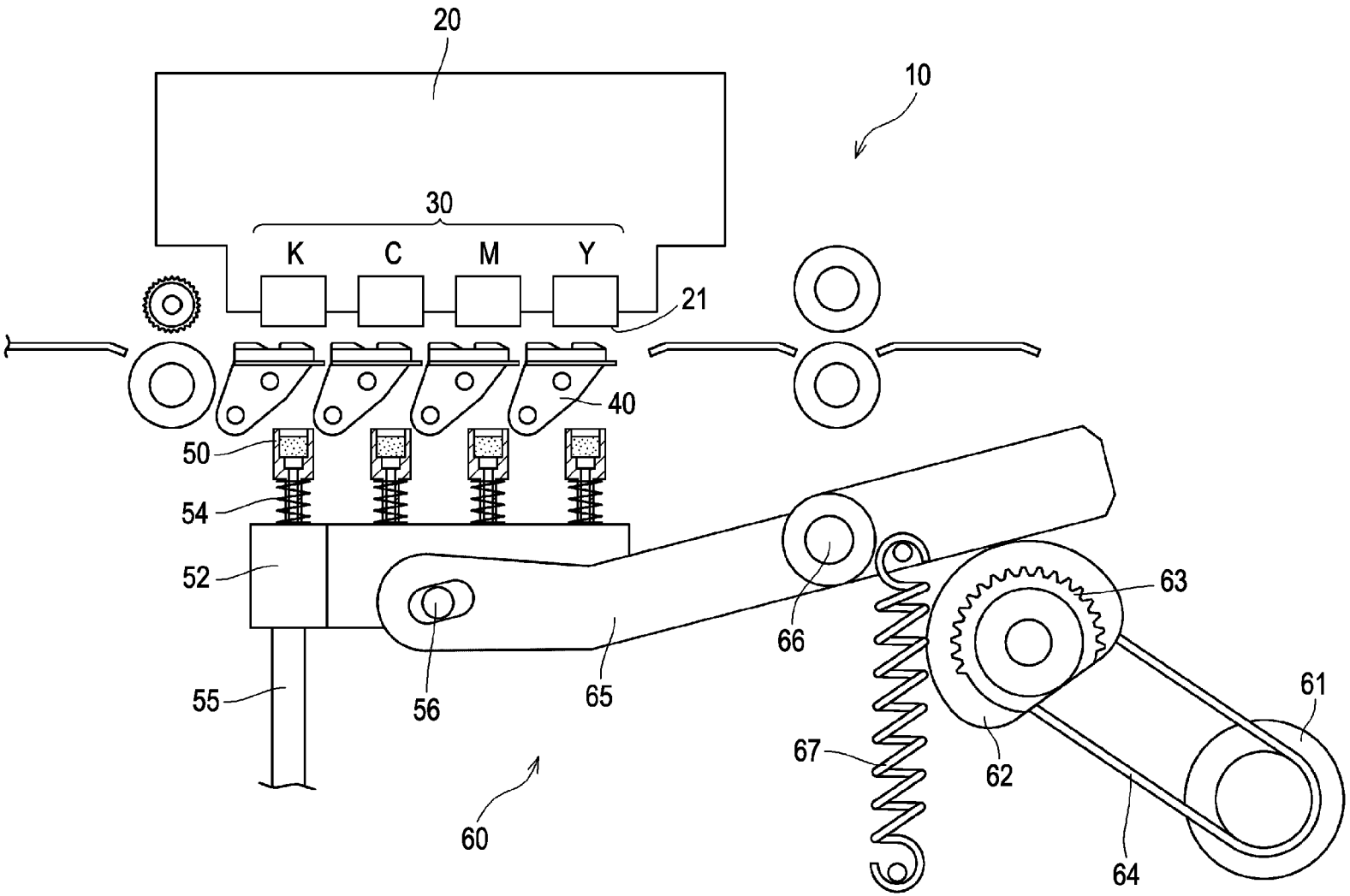
FIG. 14 is a side view of the head caps when the ink jet printer shown in FIG. 1 is performing printing.

FIG. 14 is a side view of the head caps 50 when the ink jet printer 10 shown in FIG. 1 is performing printing.

When the motor 61 is rotationally driven in the CCW direction to rotate the printing tables 40 to the horizontal orientation, not only the pinion gear 63 but also the cam 62 is rotated in the CCW direction. However, as shown in FIG. 14, even when in the position for printing, the cam 62 carries the lifting lever 65 on the portion in the form of an arc having a constant radius. Therefore, the lifting lever 65 remains in the state shown in FIG. 11 and the head caps 50 are still maintained in the lowered state.

Therefore, the head caps 50 are maintained in the position farther from the ink ejection surface 21 than the printing tables 40 and are not a hindrance when the printing tables 40 are rotated to the horizontal orientation. When the motor 61 is rotated in a CW direction (a clockwise direction) from the printing state shown in FIGS. 13 and 14, cleaning can be performed in the reverse order; that is, FIG. 12, FIG. 10 (FIG. 11) and FIG. 9 (FIG. 8). Thereafter, the ink ejection surface 21 can be capped as shown in FIG. 6 (FIG. 7), so that the state returns to the waiting state.

As described above, in the ink jet printer 10 of the present embodiment, the rotation and movement of the printing tables 40 are interlocked with the movement of the head caps 50 by the interlocking mechanism 60, and switching is performed between the waiting state, cleaning state, and printing state. Specifically, owing to the interlocking mechanism 60, when the printing tables 40 have been rotated to the horizontal orientation, the head caps 50 are situated in a position spaced from the ink ejection surface 21 of the line head 20. Therefore, the head caps 50 are not a hindrance when the recording sheet 11 (see FIG. 1) is carried on the horizontal platen portions 42 of the printing tables 40, and printing can be performed by the head modules 30.

Moreover, when the printing tables 40 are rotated to the vertical orientation and moved in a horizontal direction by using the interlocking mechanism 60, wiping (cleaning) of the ink ejection surface 21 can be performed with the upright rubber blades 41 provided on the corresponding printing tables 40. At this time, the head caps 50 are not a hindrance to the cleaning because the head caps 50 are in a position spaced from the ink ejection surface 21 of the line head 20.

Moreover, owing to the interlocking mechanism 60, when the printing tables 40 have been rotated to the vertical orientation and are not being moved in the horizontal direction, the head caps 50 can be lifted. Specifically, each of the head caps 50 can pass between two adjacent printing tables 40 by moving parallel to the printing tables 40 and come into contact with the ink ejection surface 21 of the line head 20. Therefore, in the waiting state, the ink ejection surface 21 can be capped by the head caps 50 and protected.

Furthermore, the interlocking mechanism 60 is configured such that the rotation and movement of the printing tables 40 and the movement of the head caps 50 are mechanically interlocked by using the single motor 61. As a result, instant and easy switching between the waiting state, the cleaning state, and the printing state is possible while saving space and cost and preventing physical interference. Especially, in the case of a line-type ink jet printer having a long and large line head 20, large driving force and movement are necessary for switching between the states, and therefore it is desirable to perform switching by the interlocking mechanism 60 as in the ink jet printer 10 of the present embodiment.

Furthermore, the present invention is not limited to the above-described embodiment, and various variations such as those mentioned below are possible.

(1) While in the present embodiment the liquid ejection apparatus is the line-type ink jet printer 10 having the line head 20, the liquid ejection apparatus is not limited thereto, and may be a serial-type printer that performs printing by moving a head in the width direction of the recording sheet. Moreover, applications to copiers, facsimile machines and the like instead of printers are also possible.

(2) In the present embodiment, the interlocking means is the interlocking mechanism 60 that includes the motor 61, the cam 62, the pinion gear 63, the transmission belt 64, the lifting lever 65, the slide lever 71, the horizontal tension spring 73, the horizontal guide 74, the stopper 75, and the like. However, other interlocking means may be configured by appropriately combining one or more motors, cams, gears, belts, levers, pistons and the like. Moreover, a plurality of driving sources such as motors may be provided instead of a single driving source. Moreover, the interlocking may be an electrical one instead of a mechanical one.

(3) In the present embodiment, the rubber blades 41 are used as the cleaning portion. However, the cleaning portion may be cylindrical rubber portions or the like instead of rubber blades. Alternatively, the cleaning portion may be made of a foamed material or the like.

The present application contains subject matter related to that disclosed in Japanese Priority Patent Application JP 2009-030536 filed in the Japan Patent Office on Feb. 12, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid ejection apparatus comprising:

a plurality of nozzles that eject a liquid;

a liquid ejection head in which a nozzle row of the nozzles arrayed in one direction is formed;

a rotating moving table that is rotatable between a horizontal orientation and a vertical orientation relative to a portion of the liquid ejection head in which the nozzle row is formed, and movable in a horizontal direction relative to the portion of the liquid ejection head in which the nozzle row is formed;

a head cap that is movable so as to come into contact with or become spaced from the portion of the liquid ejection head in which the nozzle row is formed; and interlocking means that interlocks the rotation and movement of the rotating moving table with the movement of the head cap, wherein the rotating moving table includes a platen portion on which a target of ejection of the liquid can be carried when the rotating moving table has been rotated to the horizontal orientation by the interlocking means, and a cleaning portion that can clean the portion in which the nozzle row is formed when the rotating moving table has been rotated to the vertical orientation and is being moved in the horizontal direction by the interlocking means, wherein when the rotating moving table has been rotated to the horizontal orientation, the head cap is situated in a position spaced from the portion in which the nozzle row is formed owing to the interlocking means, and wherein when the rotating moving table has been rotated to the vertical orientation and is not being moved in the horizontal direction, the head cap can be brought into contact with the portion in which the nozzle row is formed owing to the interlocking means.

2. The liquid ejection apparatus according to claim 1, wherein the head cap is movable in a vertical direction relative to the portion of the liquid ejection head in which the nozzle row is formed, wherein the head cap is situated in a position farther from the portion in which the nozzle row is formed than the rotating moving table when the rotating moving table has been rotated to the horizontal orientation, and wherein the head cap is movable parallel to the rotating moving table when the rotating moving table has been rotated to the vertical orientation and is not being moved in the horizontal direction.

3. The liquid ejection apparatus according to claim 1, wherein in the liquid ejection head, a plurality of the nozzle rows are formed parallel to one another, and wherein the rotating moving table and the head cap are provided for each of the nozzle rows.

4. The liquid ejection apparatus according to claim 1, wherein in the liquid ejection head, a plurality of the nozzle rows are formed parallel to one another, wherein the rotating moving table and the head cap are provided for each of the nozzle rows, wherein the head caps are movable in a vertical direction relative to the portion of the liquid ejection head in which the nozzle rows are formed, wherein the head caps are situated in a position farther from the portion in which the nozzle rows are formed than the rotating moving tables when the rotating moving tables have been rotated to the horizontal orientation, and wherein at least one of the head caps is provided such that the same is movable between adjacent two of the rotating moving tables in a direction parallel to the rotating moving tables when the rotating moving tables have been rotated to the vertical orientation and are not being moved in the horizontal direction.

5. The liquid ejection apparatus according to claim 1, further comprising:

a suction pump that is connected to the head cap and sucks the liquid from the head cap.

6. The liquid ejection apparatus according to claim 1, wherein the interlocking means is configured such that the same mechanically interlocks the rotation and movement of the rotating moving table with the movement of the head cap by using a single driving source.

7. The liquid ejection apparatus according to claim 1, wherein the liquid ejection head is a line head in which an array of the nozzles extends over a length corresponding to the width of the target of ejection of the liquid.

8. A liquid ejection apparatus comprising:

a plurality of nozzles that eject a liquid;

a liquid ejection head in which a nozzle row of the nozzles arrayed in one direction is formed;

a rotating moving table that is rotatable between a horizontal orientation and a vertical orientation relative to a portion of the liquid ejection head in which the nozzle row is formed, and movable in a horizontal direction relative to the portion of the liquid ejection head in which the nozzle row is formed;

a head cap that is movable so as to come into contact with or become spaced from the portion of the liquid ejection head in which the nozzle row is formed; and an interlocking mechanism that interlocks the rotation and movement of the rotating moving table with the movement of the head cap, wherein the rotating moving table includes a platen portion on which a target of ejection of a liquid can be carried when the rotating moving table has been rotated to the horizontal orientation by the interlocking mechanism, and a cleaning portion that can clean the portion in which the nozzle row is formed when the rotating moving table has been rotated to the vertical orientation and is being moved in the horizontal direction by the interlocking mechanism, wherein when the rotating moving table has been rotated to the horizontal orientation, the head cap is situated in a position spaced from the portion in which the nozzle row is formed owing to the interlocking mechanism, and wherein when the rotating moving table has been rotated to the vertical orientation and is not being moved in the horizontal direction, the head cap can be brought into contact with the portion in which the nozzle row is formed owing to the interlocking mechanism.

* * * * *